US005942160A

United States Patent [19]

Araki

[11] Patent Number: 5,942,160

[45] Date of Patent: Aug. 24, 1999

[54] ROTARY THROTTLE VALVE TYPE CARBURETOR

[75] Inventor: Satoru Araki, Iwate-ken, Japan

[73] Assignee: U.S.A. Zama, Inc., Franklin, Tenn.

[21] Appl. No.: 08/959,998

[22] Filed: Oct. 29, 1997

[51] Int. Cl.[6] ..... F02M 9/08

[52] U.S. Cl. ..... 261/44.8; 261/59

[58] Field of Search ..... 261/59, 35, 23.2, 261/44.2, 44.8, 44.4, 50.2, 34.2, DIG. 55, DIG. 68

[56] References Cited

U.S. PATENT DOCUMENTS

| | | | |
|---|---|---|---|
| 3,903,925 | 9/1975 | Perry | 261/44.2 X |
| 4,058,093 | 11/1977 | Kohno et al. | 261/23.2 |
| 4,122,802 | 10/1978 | Noguchi et al. | 261/44.4 X |
| 4,183,341 | 1/1980 | Eastman | 261/50.2 X |
| 4,271,096 | 6/1981 | Kobayashi | 261/DIG. 55 |
| 4,335,061 | 6/1982 | Kobayashi | 261/DIG. 68 |
| 4,335,062 | 6/1982 | Kobayashi | 261/DIG. 55 |
| 4,447,370 | 5/1984 | Kobayashi | 261/35 |
| 4,481,152 | 11/1984 | Kobayashi et al. | 261/44.8 X |
| 4,481,153 | 11/1984 | Kobayashi et al. | 261/44.8 X |
| 5,599,484 | 2/1997 | Tobinai | 261/35 X |
| 5,709,822 | 1/1998 | Togashi | 261/44.2 |

*Primary Examiner*—Richard L. Chiesa
*Attorney, Agent, or Firm*—Lyon & Lyon LLP

[57] ABSTRACT

A valve opening mechanism for a rotary throttle valve type carburetor having a lever which transmits the accelerator operation to the throttle valve. The lever and throttle valve are turned while the throttle valve is simultaneously caused to move in the central axial direction from the idle position by a cam part. This movement slightly increases the degree of overlap between a throttle orifice in the throttle valve and an air intake passage in the carburetor body, and slightly reduces the depth of insertion of a metering needle into the fuel nozzle. As a result, the amount of air and fuel is increased to an amount necessary for low-temperature starting. In operation, the cam part engages with the lever and is fixed in the operative position. Then, the lever is released by the normal operation of the accelerator, and is returned to the inoperative position by a return spring.

22 Claims, 2 Drawing Sheets

ROTARY THROTTLE VALVE TYPE CARBURETOR

FIELD OF THE INVENTION

The present invention relates to carburetors which are used to supply fuel to general purpose two-cycle engines and, more particularly, to a rotary throttle valve type carburetor which facilitates reliable starting and operation of such engines.

BACKGROUND OF THE INVENTION

A variety of carburetors are used to supply fuel to general purpose two-cycle engines. These engines are typically used as a source of motive power in small vehicles and portable machinery used in agriculture and forestry, etc. One particular type of carburetor has a structure in which a cylindrical throttle valve is installed crosswise in the air intake passage of the carburetor main body. The cylindrical throttle valve includes a throttle orifice and a metering valve, and is caused to move along its own central axial line while rotating in accordance with the operation of the accelerator pedal. The throttle valve controls the air flow rate by varying the degree of overlap of the throttle orifice with the air intake passage, and controls the fuel flow rate by varying the depth of insertion of the metering needle into the fuel nozzle. See, for example, in Japanese Patent Application Kokai No. Sho 58-101253 and Japanese Utility Model Application Kokai No. Sho 62-20158.

In a state where the accelerator pedal is released, the throttle valve is placed in a position which supplies the air and fuel necessary for idle revolution of the engine. From the idle position, the throttle valve is moved in accordance with the operation of the accelerator to increase the amounts of air and fuel.

As is universally known, the starting of an engine, especially starting at low temperatures, requires larger amounts of air and fuel than ordinary idling. Accordingly, in the aforementioned rotary throttle valve type carburetor, the throttle valve in the idle position is caused to move slightly by the operation of the accelerator so that the amounts of air and fuel are increased.

However, manual operation of the accelerator tends to result in excesses or insufficiencies in the amount of air and fuel supplied to the engine. Such excesses or insufficiencies will commonly cause the engine to fail to start. Thus, skill is required in order to obtain reliable starting. In addition, manual operation of the accelerator is extremely inconvenient because the state of operation of the accelerator must be maintained such that the throttle valve is held in an "increase" position until engine warm-up is completed.

The present invention tends to solve the above-mentioned problems, i.e., the difficulty of achieving reliable starting at low temperatures of engines equipped with a rotary throttle valve type carburetor and the inconvenience associated with such starting. An object of the present invention is to provide a carburetor which makes it possible to achieve reliable starting by means of an extremely simple operation that tends not to require any skill, and which also has a function that allows a smooth transition to ordinary operation. A further object of the present invention is to enable reliable low-temperature starting of an engine by holding the throttle valve in an air and fuel "increase" position by means of a simple operation that tends to require no skill.

In the present invention a rotary throttle valve type carburetor, which is constructed to solve the aforementioned problems, includes (i) a cylindrical throttle valve which is installed crosswise in the air intake passage of the carburetor main body, and which has a throttle orifice and a metering needle; (ii) a push spring which drives the throttle valve toward the idle position; (iii) a fuel nozzle which is installed on a central axial line of the throttle valve and which opens into the throttle orifice, and into which the metering needle is inserted; and (iv) a constant-fuel chamber which holds fuel that is fed out from the fuel nozzle. The rotary throttle valve type carburetor of the present invention controls the air and fuel flow rates within it by turning a lever in accordance with the operation of the accelerator. Rotation of the lever which is mounted on the tip end of a valve shaft that protrudes from the throttle valve to the outside of the carburetor main body, causes the throttle valve to move along its central axial line while rotating.

A valve opening mechanism is also provided. The valve operating mechanism includes (i) a cam part that causes the lever to turn from the idle position to a position which slightly increases the amount of air and fuel supplied, and (ii) a return spring. The cam part of the valve-opening mechanism is manually moved from an inoperative position to an operative position where said cam part engages the lever in the idle position and places the throttle valve in the "increase" position. The cam part is fixed in the operative position by the spring force of the push spring. The cam part is returned to the inoperative position by the return spring when the lever is released.

As a result, the throttle valve can be moved to a prescribed "increase" position by means of an extremely simple operation which tends to require no skill, i.e., manual movement of the cam part. Furthermore, the throttle valve is held in the "increase" position even if the hand is removed, so that reliable starting is possible. Moreover, when the lever is turned by the operation of the accelerator, the lever is released from the cam part so that a smooth transition to normal operation can be achieved.

Furthermore, if an anchoring means is provided starting is made even more reliable. The anchoring means engages the lever and holds the throttle valve in the "increase" position when the cam part is moved into the operative position, and adds to the spring force of the push spring so that the cam part is fastened in a stable manner in the operative position.

In cases where a stroke regulating means is provided, starting is made even more reliable. The stroke regulating means causes the cam part to move a fixed distance between the inoperative position and the operative position which causes the throttle valve to be moved to a fixed "increased" position, thus making starting more reliable.

BRIEF DESCRIPTION OF THE DRAWINGS

FIG. 3A is a partial longitudinal sectional view, and FIG. 3B is a partial plan view.

DETAILED DESCRIPTION OF THE PREFERRED EMBODIMENT

Figure 1:
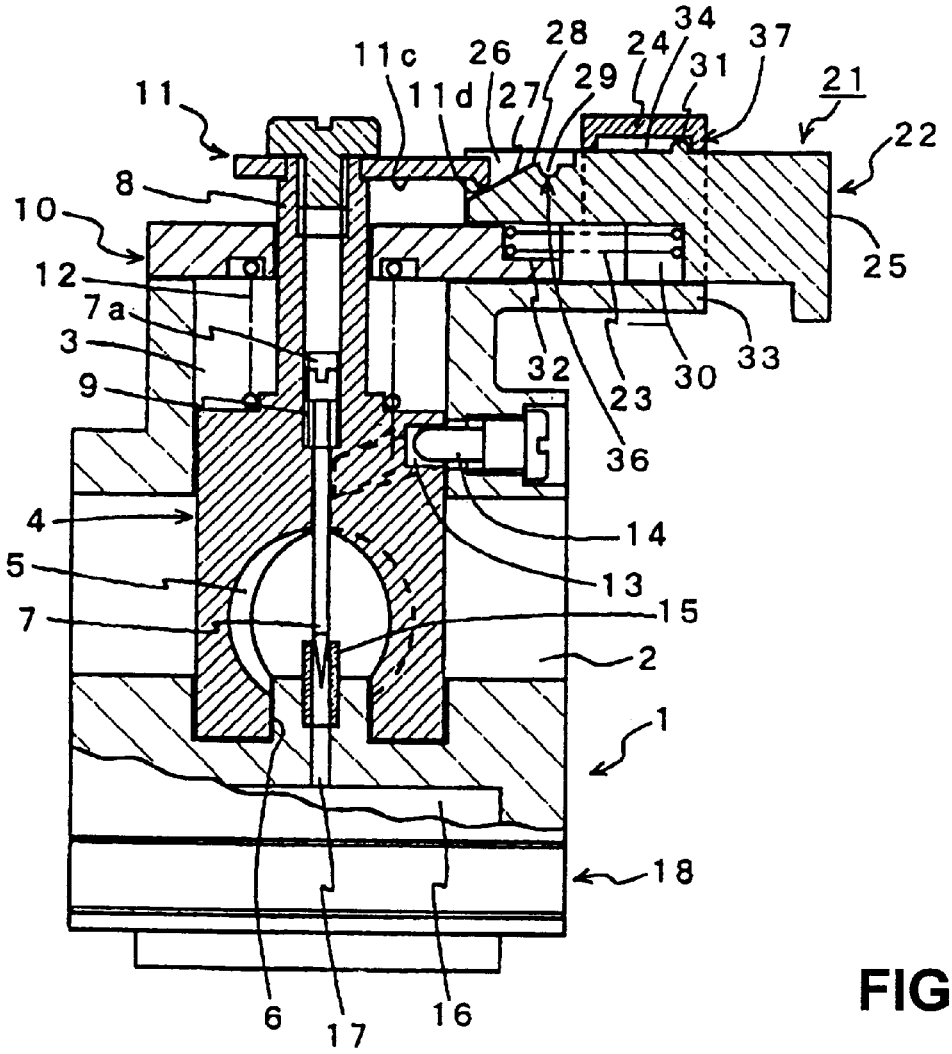
FIG. 1 is a longitudinal sectional view which illustrates one working configuration of the present invention.
Figure 2:
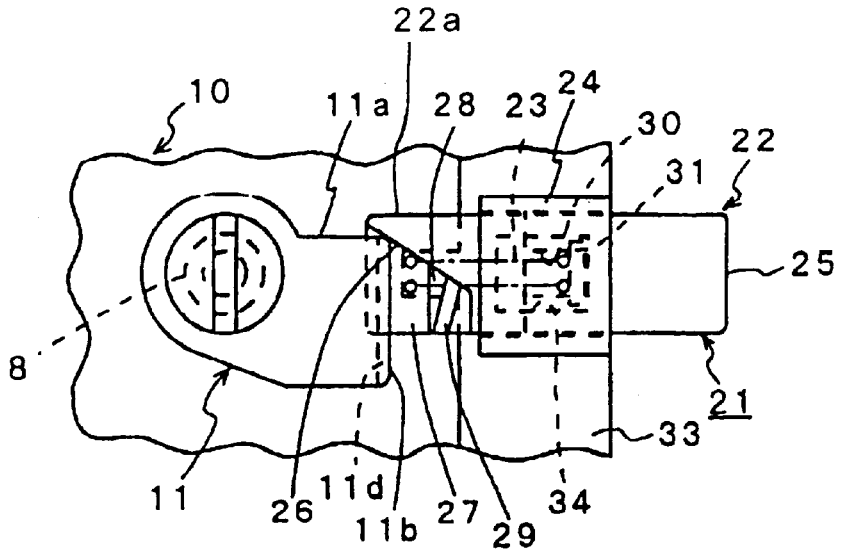
FIG. 2 is a partial plan view of the embodiment shown in FIG. 1.
Figure 3A:
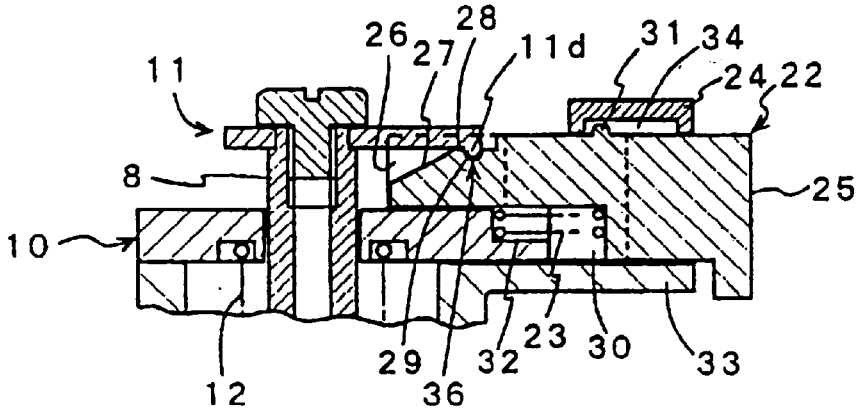
FIGS. 3A and 3B illustrate the placement of the cam part in the operative position.
Figure 3B:
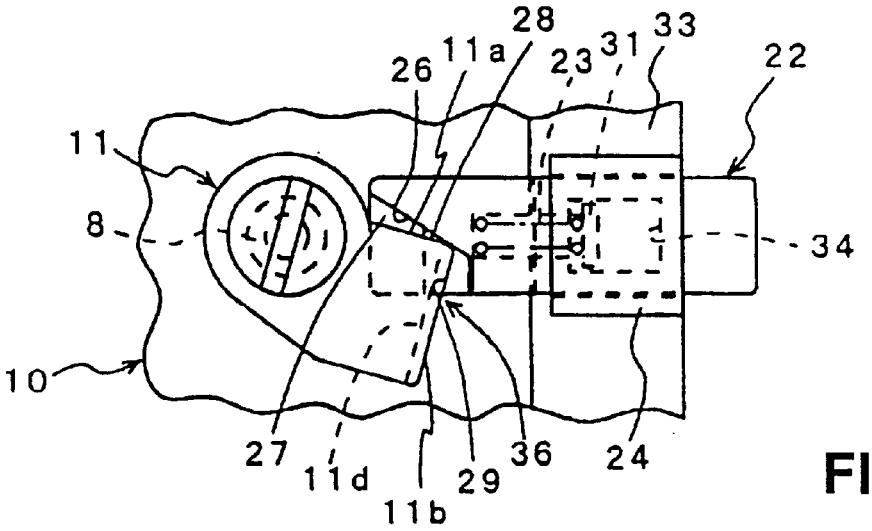

A working configuration of the present invention will be described with reference to the attached figures. In FIG. 1, the carburetor main body 1 has an air intake passage 2 which passes longitudinally through the carburetor main body 1, and a valve hole 3 which is perpendicular to the air intake passage 2, and which is closed at one end. A cylindrical throttle valve 4 is inserted into the valve hole 3 so that said throttle valve 4 can rotate, and so that said throttle valve 4 can move in the central axial direction.

The throttle valve 4 has a throttle orifice 5 which is perpendicular to the central axial line of the throttle valve 4 and which has approximately the same diameter as the air intake passage 2. The throttle valve 4 also has a nozzle insertion orifice 6, a metering needle 7 and a valve shaft 8 which are installed on the central axial line of the throttle valve 4. The nozzle insertion orifice 6 is formed in the end portion located at the closed end of the valve hole 3. The valve shaft 8 is an integral part of the throttle valve 4. The valve shaft 8 extends from the end portion of the throttle valve 4 located at the open end of the valve hole 3, and passes through the cover body 10 of the valve hole 3 so that said valve shaft 8 protrudes to the outside of the carburetor main body 1. The metering needle 7 is fastened in the throttle valve 4 in such a manner that the distance by which said metering needle 7 protrudes into the throttle orifice 5 can be adjusted by screwing a screw head part 7*a* at the base end of the metering needle 7 into a screw hole 9.

A lever 11, which is turned by the operation of the accelerator by an operator, is fastened to the shaft end of the valve shaft 8. Furthermore, a push spring 12 consisting of a compression coil spring is mounted between the cover body 10 and the throttle valve 4 so that said push spring 12 surrounds the valve shaft 8. A groove cam 13 is formed in the outer circumferential surface of the throttle valve 4 so that the groove cam 13 extends around roughly one-fourth of the circumference of the throttle valve 4. A supporting pin 14 which is screwed into the carburetor main body 1 is inserted and engaged in the groove cam 13.

When the lever 11 is turned by the operation of the accelerator, the throttle valve 4 rotates as a unit with the lever 11, thus causing the degree of overlap between the throttle orifice 5 and the air intake passage 2 to vary so that the intake air flow rate of the engine is controlled. At the same time, the throttle valve 4 moves along the central axial line in accordance with the groove cam 13, thus causing the depth of insertion of the metering needle 7 into the fuel nozzle 15 to vary so that the fuel flow rate is controlled. This operation is the same as that of a conventional rotary throttle valve type carburetor.

A constant-fuel chamber 16 which is the same as that of a well-known diaphragm type carburetor is formed in the opposite end surface of the carburetor main body 1 from the cover body 10. The fuel chamber 16 is separated from the atmosphere by a diaphragm. The fuel in the constant-fuel chamber 16 passes through a fuel passage 17, and is blown into the throttle orifice 5 from the fuel nozzle 15, and thus supplied to the engine.

Furthermore, a fuel pump 18 is installed on the outside of the constant-fuel chamber 16. This fuel pump 18 is a well-known pump in which the diaphragm is operated by the pulse pressure generated in the crankcase of the engine, so that fuel in the fuel tank is supplied to the constant-fuel chamber 16.

A valve-opening mechanism 21 which is an essential part of the present invention is installed on the cover body 10. This valve-opening mechanism 21 is equipped with a substantially square cam part 22 which performs a linear reciprocating movement along the outside surface of the cover body 10, and a return spring 23 which places the cam part 22 in an inoperative position. The cam part 22 is passed through a gate-formed guide part 24 which protrudes from it the outside surface of the cover body 10.

The base end surface of the cam part 22 is formed as a flat pushing surface 25 which is suitable for application of the fingertips. A first cam surface 26, which contacts the side surface 11*a* of the lever 11 and pushes the lever 11 so that the lever 11 is caused to turn in the direction that increases the air flow rate, is formed on the tip end portion 22*a* of the cam part 22. A second cam surface 27, also formed on the tip end portion 22*a* of the cam part 22, contacts the tip edge 11*b* of the lever 11 and pushes the lever 11 so that the lever 11 is caused to move in the axial direction that increases the fuel flow rate. A holding surface 28 which overlaps with the tip end portion 11*c* of the inside surface of the lever 11 is also formed on the tip end portion 22*a* of the cam part 22. An engaging groove 29 is formed in the holding surface 28. The portion of the tip edge 11*b* of the lever 11 which contacts the second cam surface 27, forms an engaging pawl lid that is inserted into the engaging groove 29.

A groove hole 30 in which a portion of the return spring 23 is mounted, and a projection 31 which is used for stroke regulation, are formed in the base end portion of the cam part 22. A cut-out groove 32 in which a portion of the return spring 23 is mounted is formed in one edge of the cover body 10. The above-mentioned guide part 24 is disposed on a receiving edge 33 which protrudes outwardly from the carburetor main body 1. A regulating groove 34 used for stroke regulation is formed in the inside surface of the guide part 24.

The aforementioned cam part 22 is passed through the guide part 24 so that the tip end portion 22*a* of the cam part 22 overlaps with the cover body 10, and so that the base end portion of the cam part 22 overlaps with the receiving edge 33. The stroke of the cam part 22 in the longitudinal direction is regulated by a projection 31 which is inserted into the regulating groove 24. The cam part 22 is held in the inoperative position (in which the cam part 22 is withdrawn in a direction toward its base end) by the above-mentioned return spring 23 (consisting of a compression coil spring) which is mounted in the cut-out groove 32.

While in the idle position, the side surface 11*a* and tip edge 11*b* of the lever 11, respectively, contact the first cam surface 26 and second cam surface 27, respectively, or are slightly separated from said cam surfaces 26 and 27, respectively.

In order to start the engine, the operator's fingertips are pressed against the pushing surface 25 such that the cam part 22 is caused to advance wherein the first cam surface 26 pushes the side surface 11*a* so that the lever 11 is caused to turn in the direction that increases the air flow rate. At the same time, the second cam surface 27 pushes the tip edge 11*b* so that the lever is caused to move in the direction that increases the fuel flow rate. However, the lever 11 stops when the engaging pawl 11*d* engages in the engaging groove 29.

The second cam surface 27 is formed with an angle of inclination which is equal to or greater than that of the groove cam 13. As a result of the aforementioned movement of the lever 11, the degree of overlap between the air intake passage 2 and the throttle orifice 5 of the throttle valve 4 is slightly increased, and the depth of insertion of the metering needle 7 into the fuel nozzle 15 is slightly reduced, so that the amounts of air and fuel necessary for starting are supplied to the engine. In this case, the object of the present invention is to improve starting performance at low temperatures. Accordingly, it is desirable that the angle of inclination of the second cam surface 27 be set at a larger value than the angle of inclination of the groove cam 13, so that the increase in the fuel flow rate is greater than the increase in the air flow rate.

The tip end portion 11*c* of the inside surface of the lever 11 is pressed against the holding surface 28 by the spring force of the push spring 12, so that even if the fingers are removed, the cam part 22 is fixed in the operative position by the frictional force generated between the above-mentioned parts, and is not returned by the spring force of the return spring 23.

In the working configuration shown in the figures, the lever 11 is mechanically coupled with the cam part 22 by an anchoring means 36 comprising of the engaging pawl lid and engaging groove 29. Accordingly, the lever 11 is stably fixed in the operative position so that starting can be performed even more reliably.

When warm-up of the engine is completed, and a transition to normal operation is to be made, the lever 11 is caused to turn in the direction of increase of fuel and air by ordinary operation of the accelerator. As a result, the engaging pawl 11*d* is released from the engaging groove 29 at more or less the same time. Furthermore, the tip end portion 11*c* of the inside surface is separated from the holding surface 28 so that the cam part 22 is returned to the inoperative position by the spring force of the return spring 23. Afterward, the lever 11 can be turned from the idle position to the full-open position by operation of the accelerator, without being constrained by the cam part 22.

The cam part 22 returns to the inoperative position (where the return spring 23 recovers its extended length), and remains in this position. In the working configuration shown in the figures, the stroke regulating means 37, comprising the projection 31 and regulating groove 34, prevents the cam part 22 from advancing to an excessive degree wherein the lever 11 is turned more than is necessary. In addition, this stroke regulating means 37 eliminates any concern that the cam part will be withdrawn beyond the inoperative position wherein the cam part 22 would fall out of the cover body 10 and carburetor main body 1. Moreover, in cases where no anchoring means 36 is provided, this stroke regulating means 37 enables the cam part 22 to move to a fixed operative position so that stable starting can be accomplished.

Instead of inserting the cam part 22 into a gate-formed guide part 24, it would also be possible to cause movement between the inoperative position and the operative position using a dovetail groove or other well known sliding guide means. Furthermore, instead of using a compression coil spring, it would also be possible to use a hollow or solid block consisting of a highly elastic material, e.g., rubber, as the return spring 23.

As was described above, the present invention is devised so that a lever which transmits the operation of the accelerator to the throttle valve is turned slightly from the idle position by a cam part which causes the throttle valve to be held in a state that increases the amounts of air and fuel supplied to the engine. Accordingly, starting of the engine at low temperatures can be reliably accomplished by means of an extremely simple operation. Furthermore, the transition to normal operation by means of the accelerator can be smoothly accomplished. Moreover, in cases where an anchoring means for the lever and cam part and a stroke regulating means for the cam part are provided, starting can be accomplished even more reliably.

While the above description contains many specifics, these should not be construed as limitations on the scope of the invention, but rather as examples of particular embodiments thereof. Many other variations are possible. Accordingly, the scope of the present invention should be determined not by the embodiments described herein, but by the appended claims and their legal equivalents.

What is claimed:

1. A rotary throttle valve carburetor comprising a main body with an air intake passage, a cylindrical throttle valve installed in said main body, a fuel nozzle operably coupled to said throttle valve, a lever connected to said throttle valve, said lever being adapted to transmit the operation of an engine accelerator to said throttle valve, a cam mechanism operably coupled to said throttle valve and adapted to vary a fuel flow rate from said fuel nozzle, and a valve opening mechanism operably coupled to said throttle valve and adapted to move from an inoperative position to an operative position to increase air flow and fuel flow rates.

2. The rotary throttle valve carburetor of claim 1 wherein said valve opening mechanism comprises a cam part having first and second cam surfaces, said first cam surface being adapted to increase the air flow rate, said second cam surface being adapted to increase the fuel flow rate.

3. The rotary throttle valve carburetor of claim 2 further including a return spring being adapted to return said cam part to an inoperative position.

4. The rotary throttle valve carburetor of claim 2 wherein said cam part further comprises a holding surface adapted to frictionally engage said lever to hold said cam part in an operative position.

5. The rotary throttle valve carburetor of claims 4 wherein the rotary throttle valve carburetor further comprises a push spring which drives the throttle valve toward an idle position, said cam part being held in the operative position by the spring force of said push spring.

6. The rotary throttle valve carburetor of claim 2 further comprising an anchoring mechanism that engages said lever and holds said cam part in the operative position.

7. The rotary throttle valve carburetor of claim 6 wherein said anchoring mechanism comprises a pawl formed on the underside of said lever, and an engaging groove formed in said holding surface of said cam part, said pawl being inserted into said engaging groove to fix said cam part in the operative position.

8. The rotary throttle valve carburetor of claim 2, further comprising a stroke regulating member that causes said cam part to move a fixed distance between an inoperative position and an operative position.

9. The rotary throttle valve carburetor of claim 8 wherein said stroke regulating member comprises a projection formed on said cam part and adapted to engage a guide member coupled to said body.

10. The rotary throttle valve carburetor of claim 2 wherein the first cam surface operably engages said lever to rotate the lever and wherein the second cam surface operably engages said lever to axially raise said throttle valve.

11. The rotary throttle valve carburetor of claim 2 wherein said second cam surface has an angle of inclination equal to or greater that an angle of inclination of said cam mechanism.

12. The rotary throttle valve carburetor of claim 1 wherein said valve opening mechanism is operably and releasably coupled to said throttle valve and returnable to the inoperative position by operation of said lever with the engine accelerator.

13. A rotary throttle valve carburetor comprising a main body with an air intake passage, a cylindrical throttle valve installed in said main body, a lever connected to said throttle valve, said lever being adapted to transmit the operation of an engine accelerator to said throttle valve, and a valve opening mechanism being adapted to manually move from an inoperative position to an operative position to engage said lever and place said throttle valve in an "increase" position, said valve opening mechanism comprising a cam part having a first cam surface being adapted to engage the lever to rotate the throttle valve and a second cam surface being adapted to engage the lever to raise the throttle valve along a central axial line of said throttle valve, a holding surface adapted to frictionally engage said lever to hold said cam part in an operative position, and an anchoring mechanism that engages said lever and holds said throttle valve in an "increase" position when said cam part moves into the operative position, said anchoring mechanism including a pawl formed on the underside of said lever, and an engaging groove formed in said holding surface of said cam part, said pawl being inserted into said engaging groove to fix said cam part in the operative position.

14. The rotary throttle valve carburetor of claim 13 further including a return member being adapted to return said cam part to an inoperative position.

15. The rotary throttle valve carburetor of claim 13 wherein the rotary valve carburetor further comprises a push spring which drives the throttle valve toward an idle position, said cam part being held in the operative position by the spring force of said push spring.

16. The rotary throttle valve carburetor of claim 13, further comprising a stroke regulating member that causes said cam part to move a fixed distance between an inoperative position and an operative position.

17. The rotary throttle valve carburetor of claim 16 wherein said stroke regulating member comprises a projection formed on said cam part and adapted to engage a guide member coupled to said body.

18. A rotary throttle valve carburetor comprising a main body with an air intake passage, a cylindrical throttle valve installed in said main body, and a lever connected to said throttle valve, said lever being adapted to transmit the operation of an engine accelerator to said throttle valve, and a valve opening mechanism adapted to engage said lever independent of the engine accelerator, said valve opening mechanism having a first cam surface being adapted to engage the lever to rotate the throttle valve and a second cam surface being adapted to engage the lever to raise the throttle valve along a central axial line of said throttle valve.

19. A rotary throttle valve carburetor of claim 18 wherein said valve opening mechanism is movable between an inoperative position and an operative position and including a return member adapted to return said valve opening mechanism to an inoperative position.

20. A rotary throttle valve carburetor of claim 19 wherein said valve opening mechanism further comprises an anchoring mechanism that operably engages said lever.

21. A rotary throttle valve carburetor of claim 19 further comprising a stroke regulating member that causes said valve opening mechanism to move a fixed distance between an inoperative position and an operative position.

22. A rotary throttle valve carburetor of claim 19 wherein said valve opening mechanism is operably and releasably coupled to said lever and returnable to an inoperative position when said lever is further rotated by the engine accelerator.

* * * * *

UNITED STATES PATENT AND TRADEMARK OFFICE

CERTIFICATE OF CORRECTION

| | | |
|---|---|---|
| PATENT NO | : | 5,942,160 |
| DATED | : | August 24, 1999 |
| INVENTOR(S) | : | Satoru Araki |

It is certified that error appears in the above-identified patent and that said Letters Patent are hereby corrected as shown below:

On the Title Page:

After "Filed: Oct. 29, 1997" insert "Foreign Application Priority Data Oct. 29, 1996 [JP] Japanese Patent Office 8 303589".

Signed and Sealed this

Third Day of April, 2001

*Attest:*

Nicholas P. Godici

NICHOLAS P. GODICI

*Attesting Officer*

*Acting Director of the United States Patent and Trademark Office*